US006637387B1

(12) United States Patent
Gecim et al.

(10) Patent No.: US 6,637,387 B1
(45) Date of Patent: Oct. 28, 2003

(54) VARIABLE VALVE ACTUATING MECHANISM WITH MAGNETORHEOLOGICAL FLUID LOST MOTION DEVICE

(75) Inventors: Burak Abdulkadir Gecim, Rochester Hills, MI (US); Hamid Vahabzadeh, Oakland, MI (US); Andrew Leslie Bartos, Clarkston, MI (US)

(73) Assignee: General Motor Corporation, Detroit, MI (US)

( * ) Notice: Subject to any disclaimer, the term of this patent is extended or adjusted under 35 U.S.C. 154(b) by 0 days.

(21) Appl. No.: 10/243,092

(22) Filed: Sep. 13, 2002

(51) Int. Cl.[7] ..... F01L 1/34

(52) U.S. Cl. ..... 123/90.16; 123/90.11; 123/90.48

(58) Field of Search ..... 123/90.1–90.67; 188/267.2; 267/140.14; 137/909

(56) References Cited

U.S. PATENT DOCUMENTS 4,930,463 A * 6/1990 Hare, Sr. ..... 123/90.11
5,103,779 A * 4/1992 Hare, Sr. ..... 123/90.11
5,315,961 A 5/1994 Wichelhaus ..... 123/90.11
6,321,706 B1 * 11/2001 Wing ..... 123/90.16
6,378,558 B1 * 4/2002 Pohl et al. ..... 137/827

* cited by examiner

*Primary Examiner*—Thomas Denion
*Assistant Examiner*—Kyle Riddle
(74) *Attorney, Agent, or Firm*—Kathryn A. Marra

(57) ABSTRACT

Variable valve mechanisms utilize magnetorheological fluid (MRF) in lost motion devices for controlling lift and timing of engine valves and the like. The lost motion devices are designed with either of two operational modes, a direct shear mode and a valve mode. In the shear mode, the MR fluid is retained between relatively movable shear surfaces of a lost motion device and the relative motion is controlled by varying the shear strength of the fluid by a magnetic field applied to the MR fluid between the shear surfaces. In the valve mode, the flow rate of MR fluid through an orifice is controlled by varying the magnetic field to control the flow viscosity of the fluid passing through the orifice. The lost motion device units may be applied directly between an input cam and an output valve or may be applied to a pivot for a finger follower or another type of valve actuation.

7 Claims, 5 Drawing Sheets

VARIABLE VALVE ACTUATING MECHANISM WITH MAGNETORHEOLOGICAL FLUID LOST MOTION DEVICE

TECHNICAL FIELD

This invention relates to valve actuating mechanisms for engines and the like and more particularly to a variable mechanism incorporating a magnetorheological fluid lost motion device.

BACKGROUND OF THE INVENTION

Variable valve actuation mechanisms have been extensively developed and to some extent utilized to improve engine efficiency by reducing or eliminating throttling losses, improving idle stability and controlling the timing of valve opening and closing to increase engine power and/or to improve engine exhaust emissions. The development of such mechanisms has included both mechanical and hydraulic devices including mechanisms with hydraulic lost motion devices in the valve train. However, these devices have not yet reached wide spread commercial application, possibly due to low temperature viscosity problems which may affect hydraulic system performance as well as the cost of engine modifications to apply suitable hydraulic systems. MRF technology has been applied in various ways to fluid dampers, clutches and brakes, vehicle suspensions and other applications but it is not known to have been developed or applied in engine valve actuating mechanisms.

SUMMARY OF THE INVENTION

The present invention provides an improved variable valve actuating mechanism which utilizes magnetorheological fluid (MRF) in lost motion devices applied to a valve actuating system to provide improved variable actuating mechanisms for controlling engine valves and the like.

The present invention is directed primarily to the application of MRF technology to valve actuating mechanisms in which the timing and or lift of valve motion can be controlled by lost motion devices using MR fluids. A number of embodiments of MRF lost motion devices designed for application to engine valve actuating mechanisms are illustrated as examples of how MRF technology may be applied to control valve actuation.

According to the invention, the lost motion devices are designed with either of two operational modes, a direct shear mode and a valve mode. In the shear mode, the MR fluid is retained between relatively movable surfaces of a lost motion device and the relative motion is controlled by varying the shear strength of the fluid by a controlled electromagnetic flux passed through the fluid within the device. In the valve mode, the MR fluid is displaced from one portion of a chamber to another through an orifice. The flow rate through the orifice is controlled by varying the magnetic field so that the effective viscosity of the fluid is varied to control the rate of fluid volume change in the chamber.

The lost motion device units may be applied directly between an input cam and an output valve or may be applied to a pivot for a finger follower or a rocker arm type of valve actuation. Other variations of the application of lost motion devices according to the invention are of course possible.

These and other features and advantages of the invention will be more fully understood from the following description of certain specific embodiments of the invention taken together with the accompanying drawings.

DESCRIPTION OF THE PREFERRED EMBODIMENT

Figure 1:
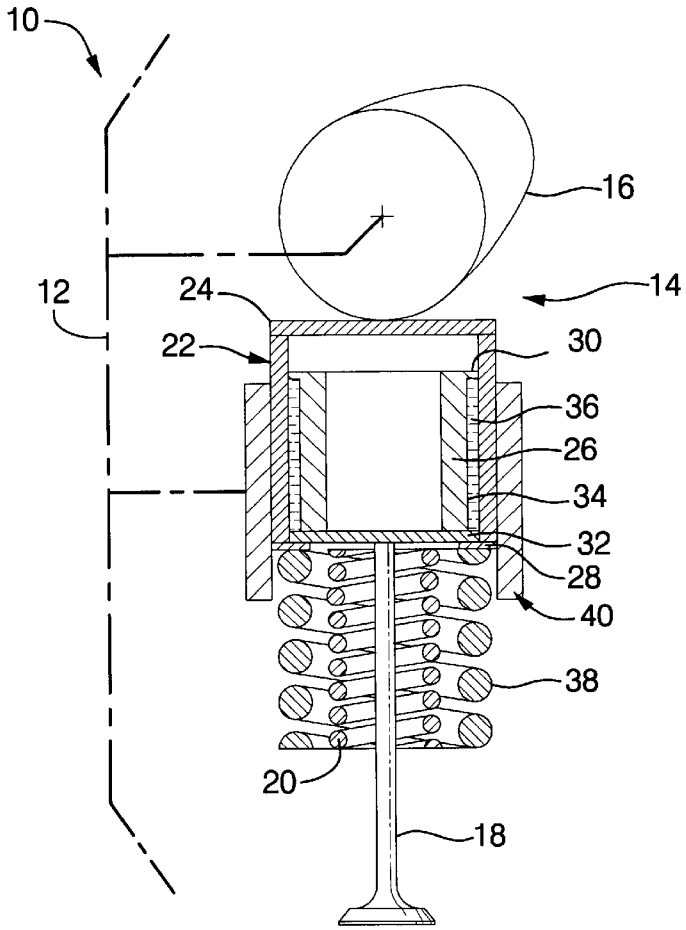
FIG. 1 is a schematic cross-sectional view of a first embodiment of valve actuating mechanism according to the invention as applied in an engine.
Figure 2:
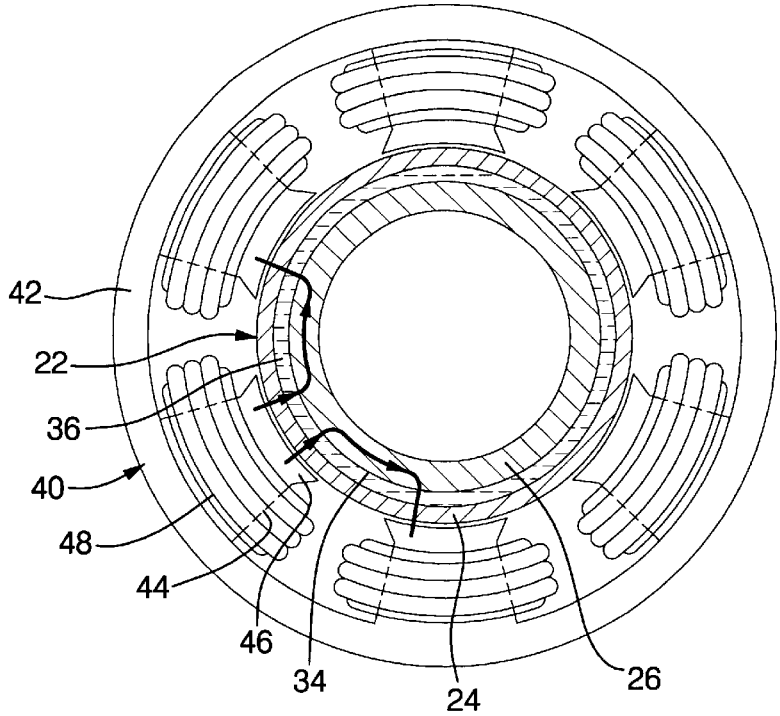
FIG. 2 is a cross-sectional view through the lost motion mechanism of FIG. 1 taken normal to the axis of motion.

Referring first to FIGS. 1 and 2 of the drawings, numeral 10 schematically indicates an engine having a support 12, such as a cylinder head, carrying a valve actuating mechanism 14 including a cam 16, a valve 18 having a return spring 20, and a lost motion device 22 connecting the cam 16 with the valve 18.

Lost motion device 22 is an assembly including a drive piston 24 actuated by the cam 16 and a driven piston 26 reciprocable within the drive piston 24 and connected with the stem of valve 18. The driven piston 26 is contained within the drive piston 24 by an end clip or ring 28.

Driven piston 26 is formed to sealingly engage the interior of the drive piston 24 at inner and outer ends 30, 32, respectively, of the driven piston 26. Between these ends an annular recess 34 is formed which is filled with a magnetorheological fluid (MRF) 36 having magnetically variable shear strength as is known for use in other applications. The MR fluid 36 is trapped within the recess 34 which has a shallow depth sufficient to retain a shear film of MR fluid in contact with both the drive and driven pistons and contained within the driven piston recess 34. A piston return spring 38 is provided which seats upon the support 12 and engages the lower portion of the drive piston 24.

Closely surrounding the drive piston 24 is an electromagnetic coil 40, shown partially in FIG. 1 but more completely in FIG. 2. Coil 40 includes an outer ring 42 supporting, for example, six inwardly directed poles 44 having ends 46 which are closely spaced from the cylindrical exterior of the drive piston 24. Electrical turns 48 wound around the poles 44 are oriented to generate a magnetic flux path in the outer ring 42 and between adjacent poles 44 through the side of the driven piston 26. This side is made of magnetic material so that a magnetic flux is formed which passes through the MR fluid 36 when the coil 40 is energized. The thin crosssections of the drive piston 24, and the MR fluid-containing recess 34 help to drive a radial, rather than axial or circumferential, flux flow. The relatively thicker cross section of the side of driven piston 26 encourages the flux to flow circumferentially to complete the magnetic loop. The flux strength is preferably controllable although it could be operated with a single strength if desired.

Material selection for components like the drive and the driven pistons 24, 26 must meet structural constraints and machinability issues that govern their counterparts in conventional valve trains. In addition, materials with high permeability, i.e. a large B/H ratio, are preferred so that the same flux density B (affecting the MR fluid shear strength) can be achieved with a small H, magnetic field strength, for lower power consumption. Material selection must also consider the issue of residual magnetism that is present after the termination of the magnetic flux. This could result in an unwanted drag force.

In operation, rotation of the cam 16 cyclically actuates the drive piston 24 in a reciprocating motion. When the coil 40 is not energized, the MR fluid 36 has low shear strength so that movement of the drive piston 24 does not provide sufficient force through the MR fluid 36 to move the driven piston 26 and open the valve 18. Thus, the valve remains closed. At the other extreme, the MR fluid 36 is preferably chosen to be made essentially stiff or extremely viscous under the magnetic flux developed when the coil 40 is fully charged. Thus, the reciprocating motion of drive piston 24 is carried entirely, or almost completely, to the driven piston 26, which opens the valve 18 to its full stroke, essentially equivalent to that of the cam lift and motion of the drive piston 24.

In one operational mode, the valve lift and timing could be controlled completely by timing the energizing of the coil 40 so that it is fully energized at the point when the valve 18 is desired to begin opening and fully de-energized at the point where the valve is desired to be closing completely. However, a preferred mode of operation provides for controlling the current through the coil 40 during valve operation so that the shear strength of the MR fluid 36 varies from a low value, where the valve 18 will not open, through various greater values which partially open the valve 18 in increasing amounts until the full energization of the coil 40 is reached and the valve 18 becomes fully opened during each cam rotation.

The amount of lift realized at valve 18 affects the reaction force generated by spring 20. This spring force and a speed-dependent inertia force have to be equalized at the MR fluid interface with the driven piston 26. Hence, by controlling the shear strength of the MR fluid 36, different amounts of lift at valve 18 can be realized. Therefore, both the timing of energization and the level of coil 40 current affect the lift event realized at valve 18. Thus, the manner of electronic control of the valve lift and timing may be suited to the particular valve or engine embodiment in which the MR fluid lost motion device is applied.

In each case when the drive piston 24 is depressed, whether or not the valve is opened, the drive piston 24 is maintained against the cam by the drive piston return spring 38. Further, when the valve 18 is opened and the cam 16 returns to the valve closing point, the valve return spring 20 is adequate to return the valve 18 to the closed position.

When the cam 16 comes to the maximum lift position, the driven piston 26 and the valve 18 that is connected with the driven piston 26 also attain their maximum displacement, provided that proper energization at coil 40 exists. During the subsequent closing motion, coil 40 remains energized such that both the drive and the driven pistons 24 and 26 and the valve 18 are displaced together without relative slippage between them. This return motion is controlled by the closing curve of cam 16. Coil 40 is de-energized upon seating of the valve 18 so that drive piston return spring 38 can return the drive piston 24 without a significant drag force from MR fluid 36. De-energizing coil 40 prior to seating of the valve 18 would allow the valve 18 to close under the force of spring 20 in an uncontrolled fashion, with upward moving drive piston 24 not being able to provide any braking force.

Figure 3:
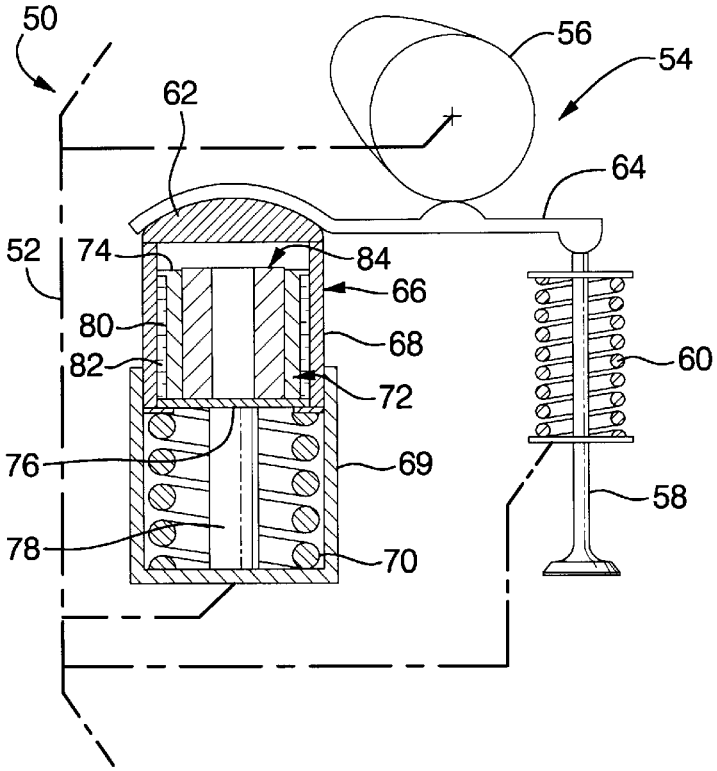
FIG. 3 is a view similar to FIG. 1 but showing an alternative embodiment of valve mechanism applied to an engine in accordance with the invention.
Figure 4:
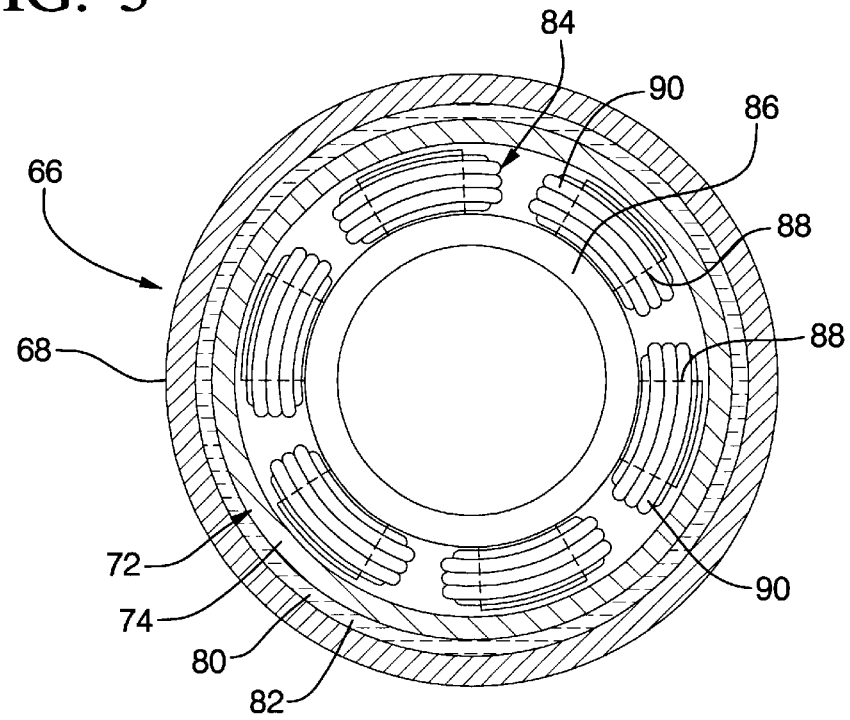
FIG. 4 is a view similar to FIG. 2 but showing the lost motion device of FIG. 3.

Referring now to FIGS. 3 and 4, there is shown schematically an engine 50 having an alternative embodiment of valve gear with an associated lost motion device. Engine 50 includes a support 52 such as a cylinder head or other engine component. Support 52 carries a valve actuating mechanism 54 including cam 56 and a valve 58 urged in a closing direction by a valve return spring 60. A pivot 62 is provided which is carried by the support 52 and in turn pivotably supports a finger follower 64 which directly or indirectly engages the valve 58 and is engaged by the cam 56.

The pivot incorporates a lost motion device 66 that includes a plunger 68, or first member, that is reciprocably carried in a housing 69 disposed in the engine cylinder head, or support 52, and is urged toward a fixed upper position by a plunger return spring 70. A fixed plunger-like inner member 72 includes a cylindrical portion 74 with a closed bottom 76 that is mounted against a stop 78 carried by the support 52. As in the embodiment of FIGS. 1 and 2, a cylindrical portion 74 of the inner member 72 includes a shallow recess 80 in which an MR fluid 82 is contained by suitable seals not shown at the ends of the inner member 72.

Inside the inner member 72, a stationary internal coil 84 is located, which may be fixed in position by any suitable method, since the inner member 72 remains stationary during operation of the valve mechanism 54. Coil 84 includes an inner core 86 as shown in FIG. 4 and outwardly extending poles 88 on which electric conductor turns 90 are applied to form the completed coil 84.

As in the previous embodiment, energizing the coil 84 causes the alternate north and south poles of the coil 84 to form a magnetic flux which extends from one of the poles 88 outward and completes the loop through the adjacent cylindrical portion of plunger 68 to an adjacent pole 88 of the coil 84. The flux passes through the MR fluid 82 contained in the recess 80 and, through control of the coil current, controllably increases the shear strength of the MR fluid 82 as determined by the operating means or program connected with the valve mechanism.

Thus, in operation, rotation of the cam 56 when the coil energy is at a maximum causes the finger follower 64 to pivot about pivot 62, which is held essentially stationary by the high shear strength of the MR fluid 82. Accordingly, the follower 64 is effective to move the valve 58 to the full open position while the pivot end of the finger follower 64 remains fixed in position on the pivot 62. When it is desired to reduce the lift of the valve 58 or change the valve timing, the electric power is controlled as desired to reduce the coil current applied during the time when the valve 58 would normally be opened. The reduced coil current allows the pivot 62 to be forced downward at a rate dependent upon the effective shear strength of the MR fluid 82 under the reduced power.

If the coil 84 is completely turned off, the plunger 68 of the lost motion device 66 moves downward freely against the force of the return spring 70 so that the finger follower 64 moves down when the cam 56 applies a load against it and the valve 58 remains closed while the plunger 68 moves down to its furthest lower position. As the cam rotates further, the return spring 70 works against the viscous drag of MR fluid 82 in the current off state and returns the finger follower 64 to its normal upper position, maintaining the finger follower 64 against the surface of the cam 56 during operation at all times.

Figure 5:
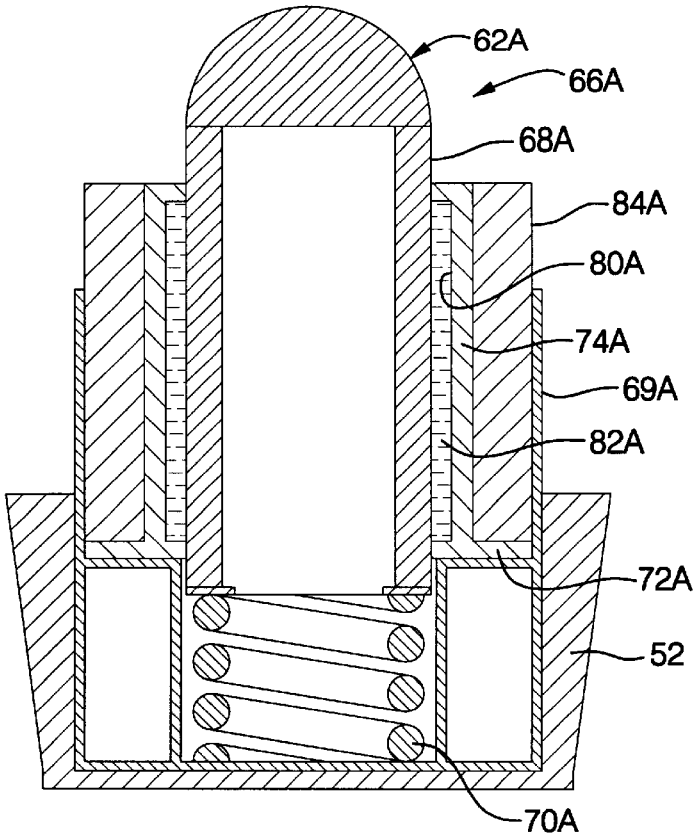
FIGS. 5 and 6 are cross-sectional views similar to FIG. 3 but showing alternative embodiments of lost motion devices.

FIG. 5 shows an alternative embodiment of lost motion device 66A modified from that of FIGS. 3 and 4 and wherein functionally similar components are designated by the reference letter A. Lost motion device 66A includes a plunger 68A surrounded by a fixed outer member 72A carried in a housing 69A and including a cylindrical portion 74A, mounting an external coil 84A. The cylindrical portion 74A has a shallow recess 80A surrounding the plunger 68A in which an MR fluid 82A is contained. A plunger return spring 70A is also included. These components of the lost motion device 66A and the surrounding structure operate in the same manner as the numerically corresponding components of the embodiment of FIGS. 3 and 4 to provide a controllable pivot 62A for a finger follower valve actuating mechanism similar to mechanism 54 (FIG. 3).

Figure 6:
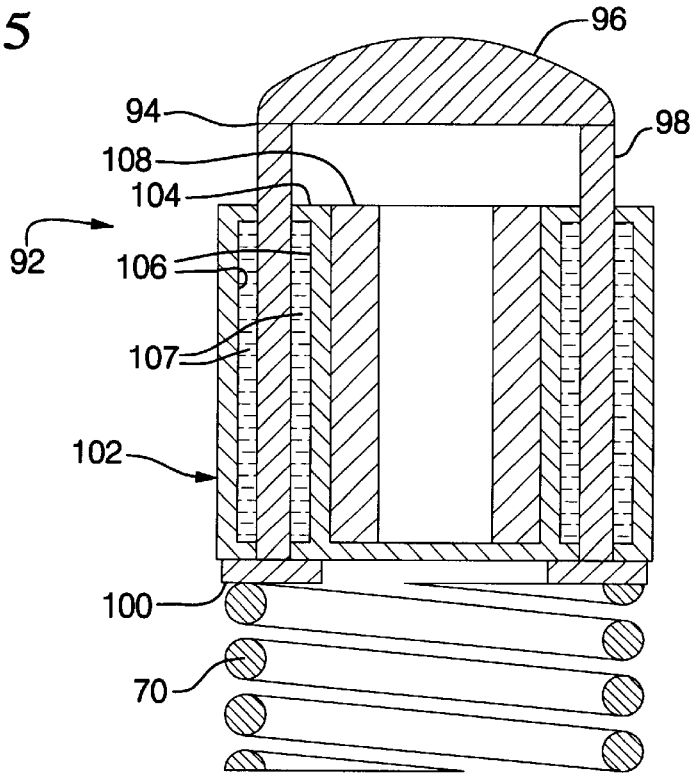

FIG. 6 represents other possible modifications of the embodiment of FIGS. 3 and 4 wherein a lost motion device 92 is provided with an increased number (such as two or more) of shear annuli in order to increase the effective force of the shear action in slowing or stopping the motion of a movable plunger of a valve pivot. In FIG. 6 the lost motion device 92 includes a movable plunger 94 having a pivot surface 96 along the top and a cylindrical wall 98 extending down to an annular seat 100 against which a plunger return spring 70 is engaged to bias the plunger upward.

Surrounding the cylindrical wall, there are provided inner and outer cylindrical bodies 102, 104, each having a shallow recess 106 in which MR fluid 107 is contained. The MR fluid 107 is sealed within the recesses 106 by suitable seals, not shown, at the upper and lower edges of the recesses. Within the inner cylindrical body 104, an internal coil 108 is provided which may be similar to coil 84 of FIGS. 3 and 4, having an inner ring with poles and conductor turns wound on the poles, not shown.

The operation of the embodiment of FIG. 6 is similar to that of FIGS. 3 and 4 except that actuation of the coil 108 develops a magnetic flux which penetrates both recesses 106 and thus provides variable shear strength fluid on both sides of the plunger cylindrical wall 98 so as to more effectively control motion of the plunger 94 without increasing the strength of the coil 108.

Figure 7:
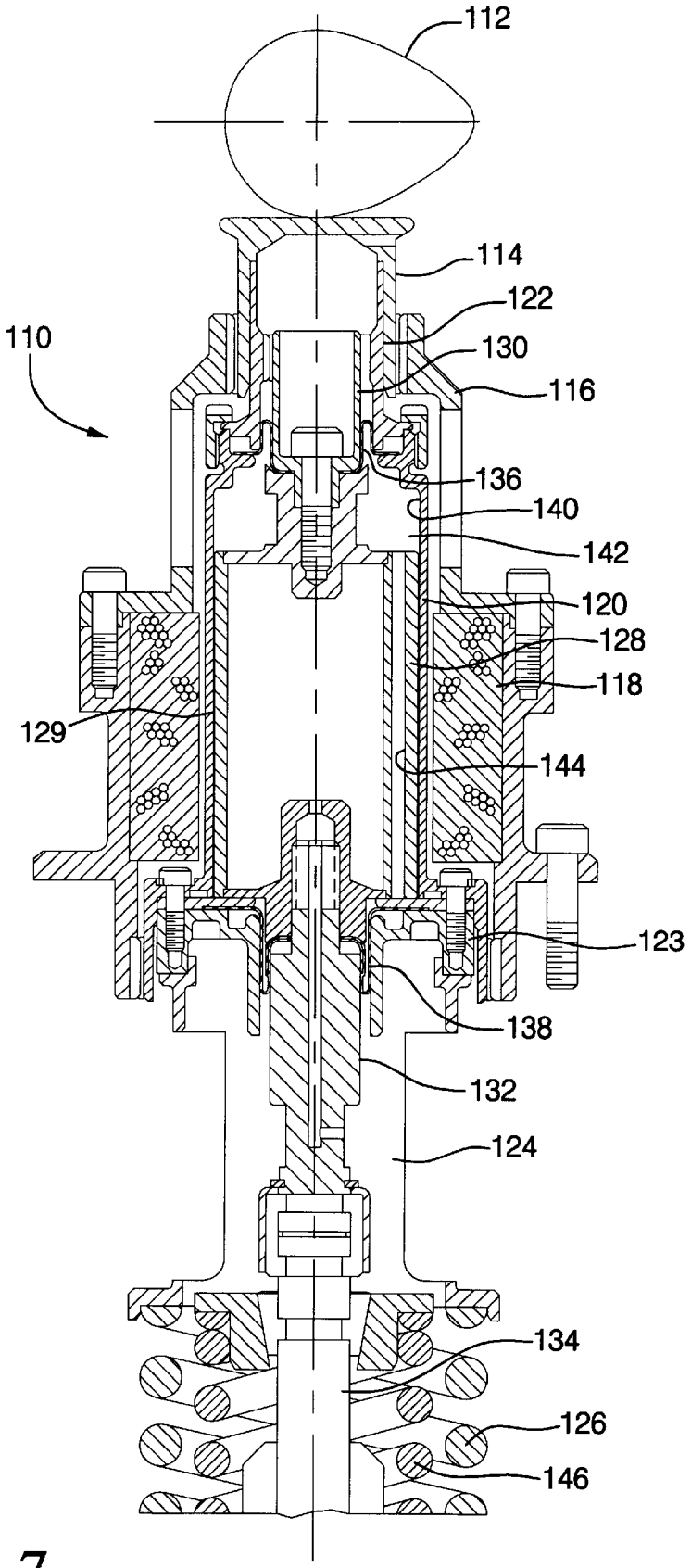
FIG. 7 is a cross-sectional view similar to FIG. 1 showing an apparatus designed for testing of MRF lost motion devices applied to actuate engine valves.

FIG. 7 illustrates pertinent portions of a test fixture 110. Although it is not intended as a practical embodiment for use in an engine, it is included in this disclosure because it represents an arrangement which could be utilized with modifications for practicing two different operational modes of the invention.

In general, fixture 110 includes a rotary cam 112 actuating a plunger 114 which slides within a housing 116 containing a surrounding magnetic coil 118. Within the housing 116 is an outer cylinder 120 which is reciprocably driven by the plunger 114 through an upper seal carrier 122. Cylinder 120 is in turn mounted to a lower seal carrier 123 which engages a lower member 124 that moves with the cylinder 120 against the bias of a plunger return spring 126.

An inner cylinder 128 is fitted closely within the outer cylinder 120 with a small clearance 129 appropriate for developing a shear film of MR fluid. The inner cylinder 128 is guided by an upper seal retainer 130 extending within the upper seal carrier 122 and a lower seal assembly 132 which extends downward to a connection with an engine valve 134.

Upper and lower seals 136, 138 seal the ends of a chamber 140 within the outer cylinder 120 in which the inner cylinder 128 is movable. Clearance 129 between the cylinders 120, 128 and portions of the chamber 140 above and below the inner cylinder 128 are filled with MR fluid 142. A through passage 144 extends the length of the inner cylinder 128 and connects upper and lower portions of the chamber 140 to allow the passage of MR fluid 142 freely between the upper and lower chamber portions. A valve spring 146 biases the engine valve 134 toward its closed position and urges the inner cylinder 128 to its furthest upper position as shown in the figure.

In operation, rotation of cam 112 reciprocates plunger 114 which drives the outer cylinder 120 downward against the bias of the plunger return spring 126. The spring 126 maintains the plunger 114 in contact with the cam 112 and so returns the outer cylinder 120 to its upper position each cycle.

When the magnetic coil 118 is de-energized, the viscous drag of the MR fluid 142 is low enough as not to cause movement of the inner cylinder 128 against the spring 146. Thus, the outer cylinder 120 moves freely along the inner cylinder 128 and the valve 134 remains closed in spite of rotation of the cam 112.

As the coil 118 is energized at an increasing level, the MR fluid 142 shear strength adjacent to the coil 118 is increased so that, when the cam 112 forces down the outer cylinder 120, the shear strength of the fluid in the clearance 129 between the outer and inner cylinders, creates sufficient force capacity to move the inner cylinder 128 down a variable distance, depending on the strength of the magnetic flux and the fluid shear strength caused thereby. Downward movement of the inner cylinder 128 opens the valve 134 against its spring 146. The spring 146 returns the valve 134 to its closed position when the cam 112 returns the plunger 114 to its upper position, or earlier at a speed higher than the cam-controlled closing speed, if the fluid shear strength permits the valve spring 146 to overcome the shear force of the MR fluid 142.

When the coil 118 reaches maximum strength, the shear strength of the MR fluid 142 reaches a maximum, causing the inner cylinder 128 to be carried downward along with the outer cylinder 120 so that rotation of the cam 112 forces the valve 134 open to its full stroke. The valve 134 is again seated when the cam 112 returns the plunger 114 to its upper position or when the coil 118 is de-energized so that the shear strength of MR fluid 142 is reduced to a negligible amount, allowing the valve spring 146 to again seat the valve 134.

The foregoing operational description involves operation of the mechanism of FIG. 7 in a shear mode wherein the shear strength of the MR fluid 142 is varied in order to vary the motion of the inner cylinder 128 relative to that of the outer cylinder 120. However, with minor modifications, the same mechanism 110 can be utilized for examining operation of a direct acting follower in the valve mode.

This could be accomplished by blocking the through passage 144 and increasing the clearance 129 between the inner and outer cylinders 128, 120 until there is a sufficient annular clearance around the inner cylinder 128 to allow free flow of the MR fluid 142 through the clearance 129 from one end of the chamber 140 to the other. If desired, the increased clearance 129 could be limited to a relatively short length of the inner cylinder 128 and the rest of the cylinder could be further reduced in diameter so as not to have a significant effect upon the operation of the annual clearance 129 which serves as a valve orifice.

In this "valve" mode of operation, rotation of the cam 112 drives the outer cylinder 120 downward as before and it decreases the volume of the upper portion of the chamber 140. This decrease causes flow of the MR fluid 142 through the annular orifice or clearance 129 between the two cylinders. The resistance of the fluid to flow may be varied by energizing the magnetic coil 118 in varying degrees up to its maximum strength.

As the strength of the coil 118 is increased, the valve actuation varies from staying fully closed to moving partially open and finally to full opening because the flow viscosity, or resistance to flow, of the fluid increases with the increase in magnetic flux from the coil 118. Thus, as the flow viscosity is maximized, the resistance to flow through the annular orifice 129 raises the pressure in the upper portion of the chamber and drives the inner cylinder 128 downward so as to open the valve 134 as in the previous mode of operation. Thus, the embodiment of FIG. 7 shows not only the operation of a direct acting plunger in the shear mode but also is illustrative of its operation in the so-called valve mode.

Figure 8:
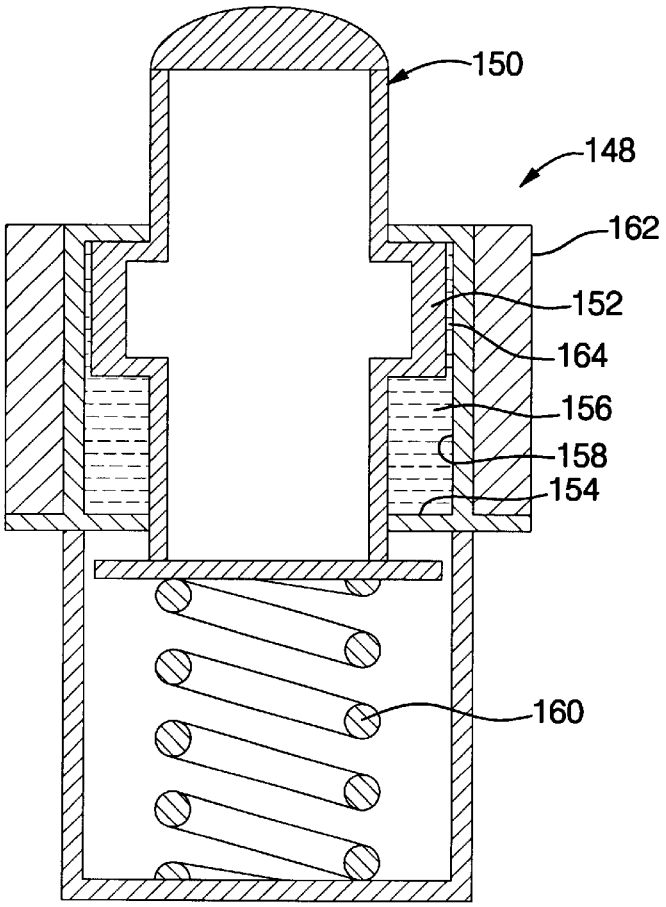
FIGS. 8 and 9 are views similar to FIG. 3 but showing another alternative embodiment of finger follower lost motion device shown operating in the valve mode in fully expanded and fully collapsed positions, respectively.
Figure 9:
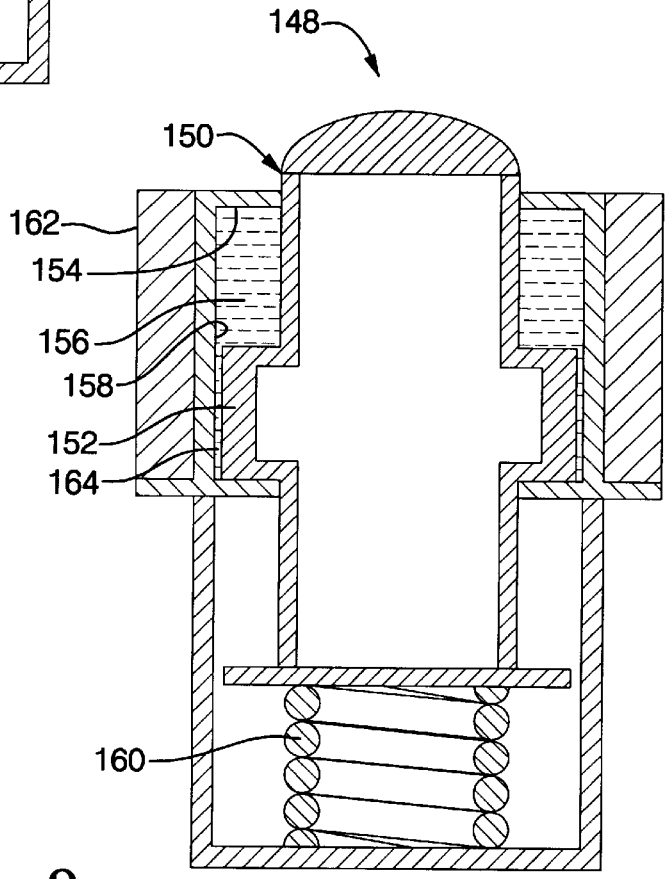

Referring now to FIGS. 8 and 9, there is shown a lost motion finger follower pivot 148 illustrated in its upper and lower positions, respectively. Pivot 148 is designed for operation in the valve mode and includes a plunger 150 having an enlarged piston 152 intermediate the plunger ends. The piston 152 is contained to reciprocate within a chamber 154 filled with MR fluid 156. The chamber 154 is formed within a cylinder 158 carried within a support, such as an engine cylinder head, not shown. The lower end of the plunger 150 engages a return spring 160 which seats against the lower end of the cylinder 158 and urges the plunger 150 toward its upper position, shown in FIG. 8. A magnetic coil 162 is mounted around the chamber 154 portion of the cylinder 158 where the MR fluid 156 is contained.

In operation, the plunger 150 is engaged by a finger follower 64 driven by a cam 56 as shown in FIG. 3. When the associated cam 56 is rotated to open an associated valve 58 (FIG. 3) the plunger 150 is either depressed or resists depression depending upon the viscosity of the MR fluid 156 as controlled by the strength of the magnetic coil 162 and the degree of its energization. When the coil 162 is de-energized, the plunger 150 is freely actuated downward by the cam 56 so that the plunger 150 is moved to its lower position shown in FIG. 9 as the MR fluid 156 flows freely past the piston 152 through the surrounding annular orifice 164.

As the strength of the coil 162 is increased, the viscosity of the MR fluid 156 is likewise increased so that it increasingly resists the flow of MR fluid 156 through the orifice 164. Thus, the motion of the plunger 150 will be resisted by the fluid 156 so that the valve 58 will be partially or fully open depending on the viscosity of the MR fluid 156 and the resulting amount of resistance to motion of the plunger 150. Again, when the coil 162 is fully energized, the fluid viscosity will be sufficiently high to prevent substantial motion downward of the plunger 150 so that the connected engine valve 58 will be fully opened by rotation of the cam 56.

Plunger 150 is also supported by the biasing spring 160, ensuring the fully expanded height of the pivot 148 when the coil current is off and there is no pivot reaction force. Then, spring 160 generates sufficient force to displace the MR fluid 156 through the annular orifice 164 by the upward motion of the plunger piston 152. The dimensions of the annular orifice 164 and the properties of the spring 160 also ensure that when it is desired to de-activate the valve 58 by deactivating the coil 162 the force applied by the finger follower 64 (shown in FIG. 3) can displace the plunger 150 downward freely. The pressure force generated in the chamber 154 plus the force of the spring 160 does not add up to a large reaction force at pivot 148 when the magnetic coil 162 is deactivated and the MR fluid viscosity is low.

If desired, the control of fluid viscosity may be maintained consistent throughout the opening and closing motion of the cam 56, after which the viscosity control will be removed by deactivation of the coil 162. Alternatively, the coil 162 may be activated after initial motion of the cam starts and deactivated at any time before it ends in order to reduce the stroke of the valve 58, as shown in FIG. 3, by the timing of the creation of resistance to motion of the plunger 150. Lift realized at valve 58 can be controlled by timing of energization of the coil 162 and/or by the degree of energization.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve actuating mechanism for opening and closing an engine valve with controlled variable lift of the actuated valve, said mechanism comprising:

an actuator;

a valve driven by the actuator in opening and closing motions;

a support carrying both the actuator and the valve; and a lost motion device containing magnetorheological (MR) fluid disposed in the mechanism between the actuator and one of the valve and the support for controlling the transmission of valve opening forces between the actuator and the valve, the device including magnetic means operative to controllably increase shear strength of the fluid to limit the degree of lost motion and vary the range of valve lift between minimum and maximum limits;

wherein at least some of the fluid is maintained between closely opposing surfaces of the lost motion device and the magnetic flux is applied to the maintained fluid to control the shear strength of the fluid and thereby control the resistance of the fluid to shearing action between the surfaces, thus controlling the amount of lost motion between the surfaces and the stroke of the driven member during opening of the valve.

2. A mechanism as in claim 1 wherein the lost motion device includes a drive member operatively engaged by the actuator and a driven member operatively engaging the valve, the MR fluid being in operative engagement with the drive and driven members through the closely opposing surfaces, the magnetic means including a magnetic coil operative to pass a controlled magnetic flux through the fluid in the closely opposing surfaces to vary the shear strength of the fluid and thereby vary the lift motion of the valve.

3. A mechanism as in claim 1 wherein the actuator includes a pivoting member angularly movable about a pivot carried on the support to close and open the valve, the lost motion device supporting the pivot against a reaction to valve opening forces and being controllably yieldable in response to controlled magnetic flux in the lost motion device to vary the valve lift.

4. A mechanism as in claim 3 wherein the lost motion device includes first and second relatively movable members, the pivot being mounted to the first member and the second member being mounted to the support.

5. A mechanism as in claim 1 wherein the lost motion device includes first and second relatively movable members.

6. A mechanism as in claim 1 wherein the actuator includes:

a driver operative to actuate the lost motion device in a valve opening direction and to control the rate of return of the valve and the lost motion device to initial valve closed positions; and first and second biasing means yieldably urging the valve and the lost motion device, respectively, toward their initial valve closed positions.

7. A valve actuating mechanism for opening and closing an engine valve with controlled variable lift of the actuated valve, said mechanism comprising:

an actuator;

a valve driven by the actuator in opening and closing motions;

a support carrying both the actuator and the valve; and a lost motion device containing magnetorheological (MR) fluid disposed in the mechanism between the actuator and one of the valve and the support for controlling the transmission of valve opening forces between the actuator and the valve, the device including magnetic means operative to controllably increase shear strength of the fluid to limit the degree of lost motion and vary the range of valve lift between minimum and maximum limits;

wherein the lost motion device includes first and second relatively movable members;

a thin annular space between the members in which the MR fluid is sealed; and a magnetic coil adjacent the members and adapted to create a magnetic flux in the-members and passing through the fluid;

whereby the shear strength of the fluid is varied for controlling the motion of the second member in response to motion of the first member.

* * * * *